US009475507B2

(12) United States Patent
Shimokawa et al.

(10) Patent No.: US 9,475,507 B2
(45) Date of Patent: Oct. 25, 2016

(54) RAILWAY VEHICLE STEERING TRUCK

(75) Inventors: Yoshiyuki Shimokawa, Osaka, PA (US); Masaaki Mizuno, Osaka (JP); Toshiyo Yamano, Osaka (JP); Tomoki Teramae, Osaka (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 109 days.

(21) Appl. No.: 14/233,883

(22) PCT Filed: Jul. 17, 2012

(86) PCT No.: PCT/JP2012/068087
§ 371 (c)(1),
(2), (4) Date: Jan. 21, 2014

(87) PCT Pub. No.: WO2013/011979
PCT Pub. Date: Jan. 24, 2013

(65) Prior Publication Data

US 2014/0158015 A1 Jun. 12, 2014

(30) Foreign Application Priority Data

Jul. 21, 2011 (JP) ..... 2011-160279

(51) Int. Cl.
*B61F 5/38* (2006.01)
*B61F 5/30* (2006.01)
*B61F 5/44* (2006.01)

(52) U.S. Cl.
CPC . *B61F 5/38* (2013.01); *B61F 5/30* (2013.01); *B61F 5/44* (2013.01)

(58) Field of Classification Search
CPC ..... B61F 5/38; B61F 5/44; B61F 5/24; B61F 3/04; B61F 3/06; B61F 5/325; B61F 5/30
USPC ..... 105/168, 165, 218.2, 167
See application file for complete search history.

(56) References Cited

U.S. PATENT DOCUMENTS 548,365 A * 10/1895 Heath ..... B61F 5/38 105/165
4,170,179 A 10/1979 Vogel
(Continued)

FOREIGN PATENT DOCUMENTS

FR 1072207 9/1954
FR 2 548 618 1/1985
(Continued)

*Primary Examiner* — Mark Le
(74) *Attorney, Agent, or Firm* — Clark & Brody

(57) ABSTRACT

To prevent separation of a truck frame and a wheel axle and to continue supporting a vehicle, even if damage has occurred to a steering device of a steering truck in which front-back support of a steering axle is performed only by a steering mechanism. A railway vehicle steering truck provided with an axle box suspension of a steering axle, which is designed to perform support in the front-back direction of an axle box which rotatably supports the steering axle, by means of a steering device having a steering link which is rotatably connected to the axle box, and a connecting link rotatably connected to a bolster, each of these being rotatably connected to a steering lever which is rotatably connected to the a truck frame. A stopper to which the axle box comes in contact is installed both on a side where a wheelbase expands and on a side where the wheelbase contracts in the truck frame, when a front-back movement of the axle box exceeds a range of front-back movement at a time of maximum steering when the front-back movement of the axle box passes through a minimum curve.

8 Claims, 5 Drawing Sheets

(56) References Cited

U.S. PATENT DOCUMENTS

| | | | | |
|---|---|---|---|---|
| 4,628,824 | A | 12/1986 | Goding et al. | |
| 2010/0229753 | A1* | 9/2010 | Kikko | B61F 5/44<br>105/4.4 |

FOREIGN PATENT DOCUMENTS

| | | | |
|---|---|---|---|
| GB | 2 143 785 | | 2/1985 |
| JP | 59-106361 | | 6/1984 |
| JP | 4-103462 | * | 4/1992 |
| JP | 06-087446 | | 3/1994 |
| JP | 08-282488 | | 10/1996 |
| JP | 10-203364 | | 8/1998 |
| JP | 11-240450 | | 9/1999 |
| JP | 2002-211394 | | 7/2002 |
| JP | 2007-45275 | | 2/2007 |
| JP | 2007-168510 | | 7/2007 |
| JP | 2007-216815 | | 8/2007 |
| JP | 2009-234328 | | 10/2009 |
| WO | 2009/038068 | | 3/2009 |

* cited by examiner

RAILWAY VEHICLE STEERING TRUCK

TECHNICAL FIELD

The present invention relates to a railway vehicle steering truck in which a front-back connection in a vehicle moving direction between a truck frame and a wheel axle which steers (referred to below as a steering axle) is performed only by a steering device which uses a lever and a link to connect an axle box which supports both side portions of the steering axle, and a member corresponding to the truck and the vehicle. In particular, the present invention comprises a stopper mechanism which is provided in such a steering truck, in the event that the steering device is damaged.

BACKGROUND ART

In a railway vehicle steering truck, a steering axle moves in a front-back vehicle moving direction (referred to below simply as a front-back direction) by means of a steering device when passing through a curve. However, if the steering device is broken because of some type of accident, there results an extreme reduction in the supporting rigidity in the front-back direction between the truck frame and the wheel axle. Accordingly, it is necessary to prevent the truck frame and the steering axle from separating, even if the steering device breaks, and therefore, steering trucks with a variety of structures have been disclosed in the past.

For example, in Patent Reference 1 there is disclosed a truck which has an axle box front-back suspension which is arranged in parallel with the steering device. Such a truck is able to maintain a relative positional relationship between the truck frame and the steering axle by means of the axle box front-back suspension, even if the steering device is damaged.

However, in the truck disclosed in Patent Reference 1, if the steering device is operating normally, the axle box front-back suspension requires a mechanism with a broad range of motion, because the steering axle is moved to a great extent in a front-back direction by the steering device when passing through a curve.

In Patent Reference 2, there is disclosed a truck having a steering device and an axle box front-back suspension arranged integrally or in parallel. Such a truck is able to maintain a relative positional relationship between the truck frame and the steering axle, even if the steering device is damaged.

However, the truck disclosed in Patent Reference 2 has the same problem as in Patent Reference 1, because, if the steering device is operating normally, the steering axle is moved to a great extent in a front-back direction by the steering device when passing through a curve.

PRIOR ART REFERENCES

Patent References

Patent Reference 1: Japanese Patent Application Kokai Publication No. 2002-211394

Patent Reference 2: Japanese Patent Application Kokai Publication No. H08-282488

SUMMARY OF THE INVENTION

Problem to be Solved by the Invention

The problem which the present invention aims to solve is that a steering truck of the prior art requires an axle box front-back suspension which has a broad range of motion, because the steering axle is moved to a great extent in a front-back direction by the steering device when passing through a curve.

Means for Solving this Problem

The present invention has as its object to provide a support in a front-back direction of a steering axle by using only a steering mechanism during normal operation of the steering device, and to prevent separation of a truck frame and a steering axle by means of a stopper provided on an outer side of a front-back moving range at a time of a maximum steering, in the event that the steering device is damaged, and to continue supporting a vehicle body, while keeping negative effects of the damage to a minimum.

The railway vehicle steering truck according to the present invention is a railway vehicle steering truck comprising:

axle boxes that rotatably support a steering axle;

a steering lever rotatably connected to a truck frame portion;

a steering link rotatably connected to an axle body portion;

connecting links rotatably connected to the vehicle body portion;

a steering device that rotatably connects the connecting links, wherein the respective axle box is supported in a front-back direction along a vehicle moving direction by the steering link and the steering device; and a stopper to which the axle box which supports the steering axle comes in contact, wherein the stopper is installed on both a side where a wheelbase of a truck expands and on a side where the wheelbase of a truck contracts, when a front-back movement of the axle box exceeds a range of front-back movement at a time of maximum steering when passing through a minimum curve.

In addition, the railway vehicle steering truck according to the present invention is a railway vehicle steering truck comprising:

axle boxes that rotatably support a steering axle;

a steering lever rotatably connected to a truck frame portion;

a steering link rotatably connected to an axle body portion;

connecting links rotatably connected to the vehicle body portion;

a steering device that rotatably connects the connecting links, wherein axle boxes among the axle boxes arranged in a front-back direction of a vehicle moving direction on the same side along a vehicle width direction is supported in a front-back direction along a vehicle moving direction by the steering link and the steering device and a stopper which makes contact with a wheel axle, wherein the stopper is installed both at a side where a wheelbase of a truck expands and at a side where the wheelbase contracts, so that a magnitude of a front-back movement of the axle box with respect to the truck is not greater than a front-back movement at a time of maximum steering when passing through a minimum curve.

Even if the steering device breaks, the steering truck according to the present invention is able to keep negative effects of damage to the steering device to a minimum, while continuing to support a vehicle body, because front-back movement of the axle box is restricted by the stopper.

Advantageous Effects of the Invention

The present invention makes it possible to prevent the truck frame and the steering axle from separating, even if the steering device breaks in a steering truck in which support of the steering axle in a front-back direction is performed only by the steering device, and the present invention also makes it possible to limit an attack angle formed between a wheel and a rail so that it is on the same level as an attack angle when an ordinary truck is passing through a curve. It is therefore possible to enhance the safety in the event that the steering device breaks.

BRIEF DESCRIPTION OF THE DRAWINGS

FIG. 1 (*a*) is a view when moving on a straight track. FIG. 1 (*b*) is a view when moving on a minimally curved track. FIG. 1 (*c*) is an enlarged view of the wheel box and the stopper when moving on a minimally curved track.

FIG. 2 (*a*) is a drawing illustrating a time when the steering device breaks when moving on a straight track. FIG. 2 (*b*) is a drawing illustrating a time when moving on a minimally curved track.

FIG. 4 (*a*) is a drawing illustrating a state when steering is not performed. FIG. 4 (*b*) illustrates a state when steering is performed.

PREFERRED EMBODIMENT

The object of the present invention, which is to prevent a separation of a truck frame and a steering axle and to continue to support a vehicle body, even if the steering device breaks in a steering truck in which support of the steering axle in a front-back direction is performed only by the steering device, while keeping negative effects of damage to a minimum, is achieved by providing a stopper outside of a front-back moving range at a time of a maximum steering.

EXAMPLE

After describing the process from conception of the present invention to solving the problem of the prior art, an example of the present invention will be described below, using FIGS. 1-3.

Figure 6:
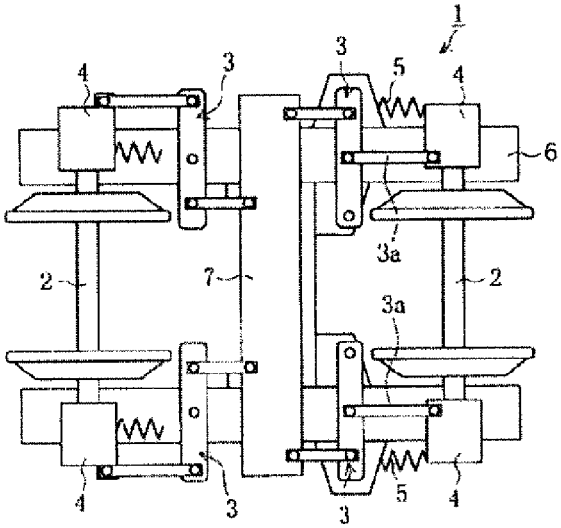
FIG. 6 is a schematic drawing illustrating the structure of a prior art steering truck as viewed from above.

A prior art steering truck 1, as shown in FIG. 6, for example, was provided in parallel with a steering device 3 for steering a steering axle 2, and an axle box front-back suspension (with a front-back suspension spring) 5 for supporting a front-back movement of an axle box 4 which rotatably supports both ends of the steering axle 2. Therefore, when steering of the steering axle 2 was performed by the steering device 3, a state was obtained in which the axle box front-back suspension 5 was caused to move at the same time. In FIG. 6, Reference Numeral 6 is a truck frame, and Reference Numeral 7 is a bolster which performs a yawing movement which corresponds to the vehicle body.

Accordingly, it was necessary for a steering link 3*a* of the steering device 3 to be strong enough not only to steer the steering axle 2, but also to be strong enough to be able to withstand a reactive force which is generated when the axle box front-back suspension 5 which is arranged in parallel thereto is caused to move greatly in a front-back direction.

The axle box front-back suspension 5 must also have a large allowable displacement in the front-back direction, as well as a durability to sustain a significant displacement, in order to accommodate a significant displacement that follows a movement of the steering device 3 when the steering axle 2 is steered when moving through a curve.

Accordingly, the present invention solves the above-described problem of the prior art steering truck by reducing as much as possible a supporting rigidity in the front-back direction of the axle box 4 within the range of motion of the steering device 3, and also by providing a stopper 12 which is set with a suitable gap provided between it and the axle box 4, outside of the range of motion of the steering device 3.

Figure 1A:
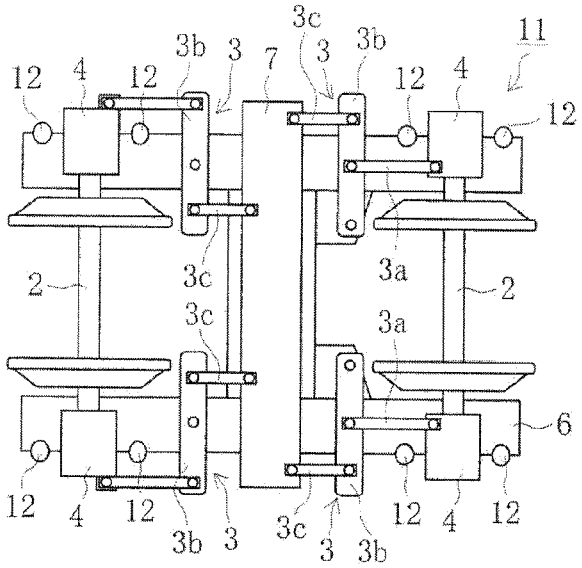
FIG. 1 shows schematic drawings illustrating the structure of a steering truck according to the present invention, as viewed from above.
Figure 1B:
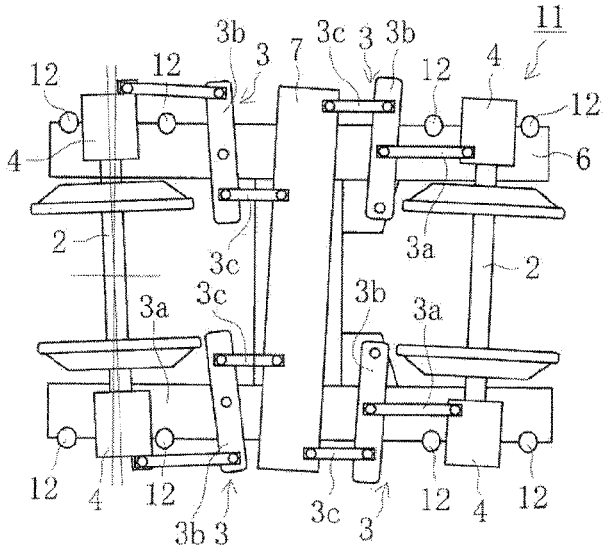
Figure 1C:
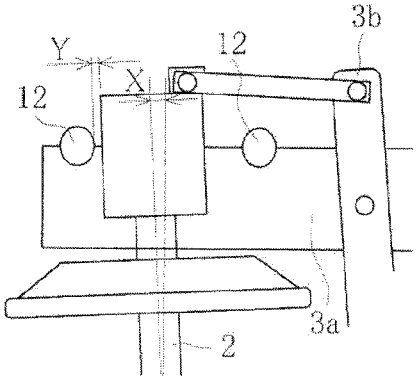
Figure 2A:
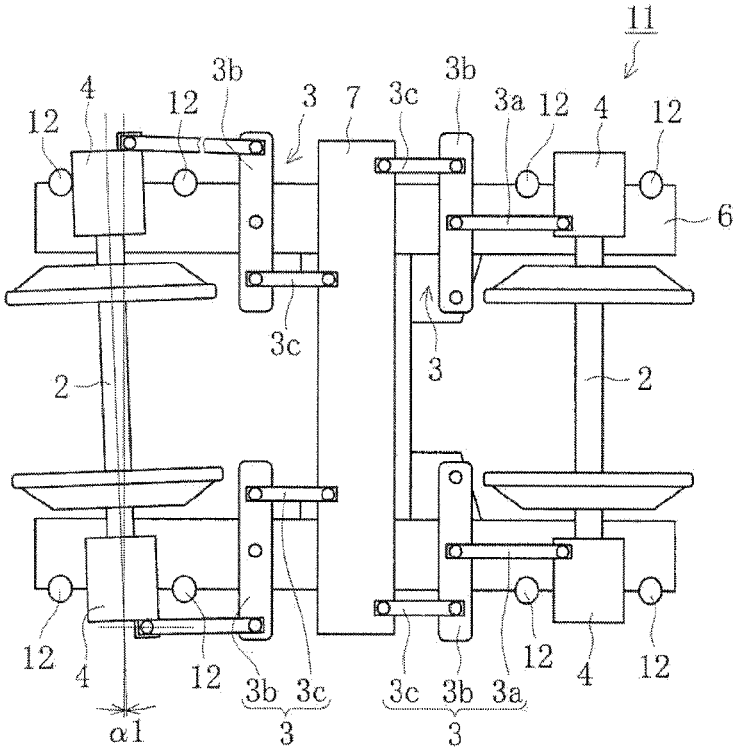
FIG. 2 shows drawings similar to FIG. 1.
Figure 2B:
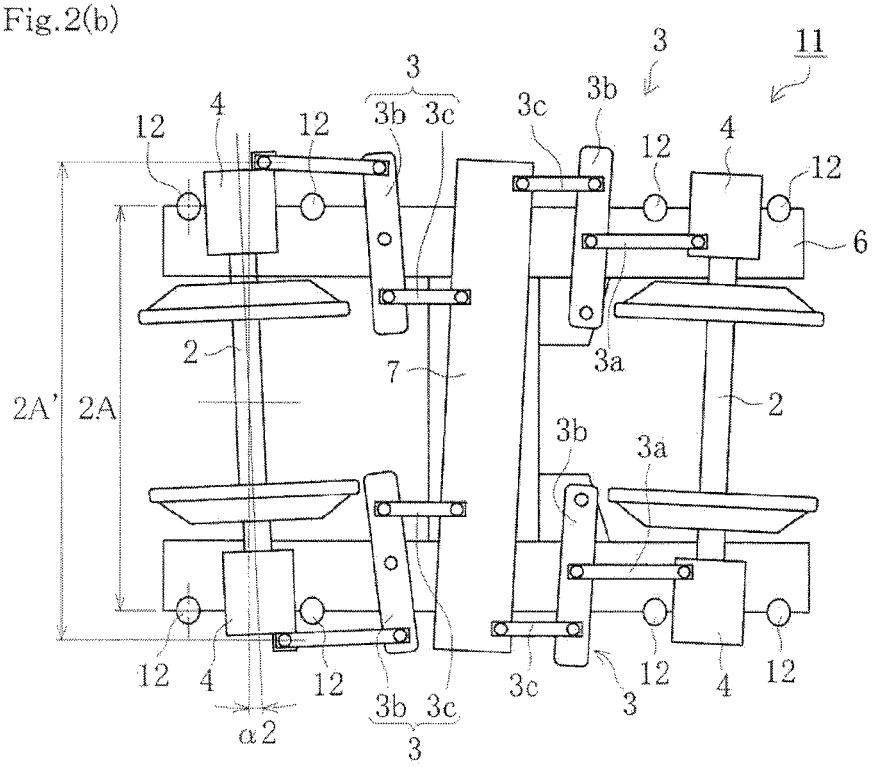
Figure 3:
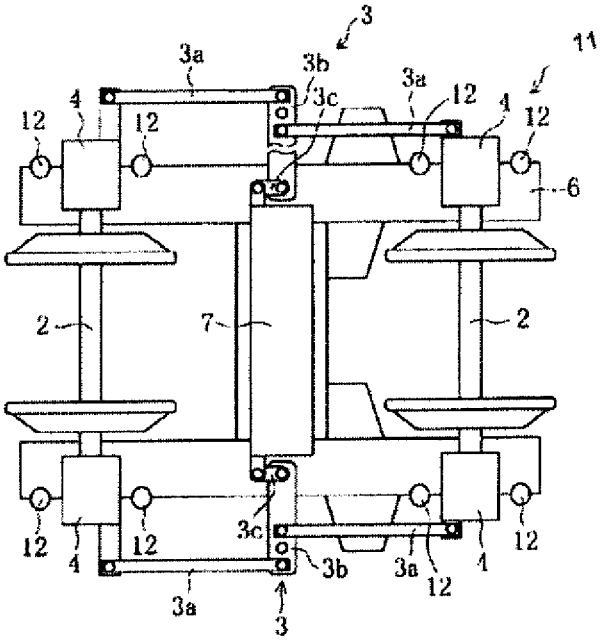
FIG. 3 is a drawing illustrating the structure of a steering truck according to the present invention, as viewed from above.

In other words, as shown in FIGS. 1-3, in order to reduce as much as possible the supporting rigidity in the front-back direction of the axle box 4 within the range of motion of the steering device 3, a steering truck 11 according to the present invention is designed without separately installing in the truck frame 6 an axle box front-back suspension to support the axle box 4 in a front-back direction.

In addition, according to the present invention, although the stopper 12 is set with a gap having a suitable magnitude between it and the axle box 4, outside of the range of motion of the steering device 3, the optimally suitable magnitude of the gap between the stopper 12 and the axle box 4 differs, depending on the manner in which the steering device 3 is mounted.

These items are described below using FIGS. 1-3.

(For the first invention, refer to FIG. 1 and FIG. 2)

The first invention is designed in such a manner that a support in a front-back direction of an axle box 4 which supports a steering axle 2 which steers, is performed by means of a steering device 3 having a steering link 3*a* which is rotatably connected to the axle box 4, and a connecting link 3*c* rotatably connected to a bolster 7, each of these being rotatably connected to a steering lever 3*b* which is rotatably connected to the truck frame 6.

The first invention is also designed in such a manner that, if a front-back movement of the axle box 4 of the steering axle 2 arises which is slightly greater in magnitude than a magnitude of a front-back movement which arises when passing through a minimum curve, then the axle box 4 or a component belonging to the axle box 4 makes contact with the stopper 12 which is provided to the truck frame 6. That is to say, the stopper 12 does not make contact with the axle box 4 when passing through a minimum curve.

Viewed from the standpoint of preventing the truck frame 6 and the steering axle 2 from separating, the stopper 12 may be installed on a side where a wheelbase expands, but if the steering device 3 is broken, it is desirable for the stopper 12 to be installed on both a side where a wheelbase expands and on a side where the wheelbase contracts, because it is conceivable that the steering axle 2 moves on a side where the wheelbase contracts.

In addition, if Y represents the magnitude of the gap between the axle box 4 and the stopper 12 when passing through a minimum curve, and X represents the magnitude of front-back movement of the axle box 4 of the steering axle 2 when passing through a minimum curve [see FIG. 1 (*c*)], then a value is set so as to be as small as possible in a range such that $Y<X$.

The reason for this is that, if $Y<X$, then it becomes possible to restrict a yawing angle $\alpha 1$ (where $\alpha 1=X+Y/2A$ rad) between the truck frame 6 and the steering axle 2 to a value smaller than a yawing angle α2 (where α2=X/A rad) at a time of maximum steering [see FIG. 1 (*c*)]. The term "2A" is defined as a center distance between the stoppers 12 in a width-wise direction of the vehicle [see FIG. 2 (*b*)].

TABLE 1 below shows attack angles formed between the wheel and the rail when the axle boxes 4 make contact with the stoppers 12 if the steering device 3 of the steering vehicle 11 shown in FIGS. 1 and 2 is broken. TABLE 1 below also includes attack angles formed between the wheel and the rail in the case of an ordinary truck in which steering is not being performed.

Incidentally, Japanese Patent No. 3,448,445 recites that the steering angle is $\sin^{-1}$ (a/R) if the attack angle formed between the wheel and the rail is zero when passing through a curve, where "a" represents half of the wheelbase and "R" represents the curve radius. The steering angle is a/R=X/A in cases in which 2A≈2A' is considered with respect to "2A" which is defined as a center distance between the stoppers 12 in a width-wise direction of the vehicle, with respect to 2A' which is defined as a steering link interval, and with respect to the magnitude of X and Y [see FIG. 2 (*b*)].

Moreover, in the case of an ordinary truck, the attack angle formed between the wheel and the rail is a/R. where "a' represents half of the wheelbase and "R" represents the curve radius. According to Railway Technical Research Institute (RTRI) Report Vol. 15, No. 4, April 2001, p. 15-20, a correction coefficient is added to the formula for the attack angle formed between the wheel and the rail (a/R), which takes into consideration factors such as slack and flange clearance.

TABLE 1

| | Attack angle when moving on a straight track | Attack angle when moving on a minimally curved track | Angle formed by the axle and the truck |
|---|---|---|---|
| Ordinary truck | 0 | a/R | 0 |
| Steering axle of steering truck | 0 | 0 | X/A (when passing through a minimum curve) |
| Steering device is broken, and stopper-axle box gap magnitude Y = 0 | a/2R | — | X/2A |
| Steering device is broken, and stopper-axle box gap magnitude Y = X | a/R | — | X/A |

TABLE 1 shows that if the magnitude Y of the gap between the axle boxes 4 and the stoppers 12 when passing through a minimum curve is set at a value lower than the magnitude X of the front-back movement of the axle box 4 of the steering axle 2 when passing through a minimum curve, the attack angle formed between the wheel and the rail can be kept lower than the attack angle when an ordinary truck is passing through a minimum curve, even if the steering device 3 is broken.

(For the second invention, refer to FIG. 3)

The second invention is designed in such a manner that axle boxes 4, among the axle boxes 4 arranged in a front-back direction along the same side of the vehicle width direction, which rotatably support a steering axle 2 are supported in a front-back direction by means of a steering device 3 having the steering link 3*a* and the connecting link 3*c*, each of these being rotatably connected to the steering lever 3*b*.

In other words, in the first invention, the steering device 3 is mounted on each of the respective steering boxes 4 of the steering axle 2. However, as shown in FIG. 3, in a case where the steering truck 11 which steers by means of a single steering device 3 with the axle boxes 4 arranged in a front-back direction on the same side in the vehicle width direction, if the steering lever 3*b*, which is a component of the steering device 3, becomes broken, the magnitude of the movement of the two steering axles 2 doubles due to the damage.

TABLE 2 shows the attack angles formed between the wheel and the rail in cases where the steering device 3 of the steering truck 11 equipped with a steering device 3 such as that shown in FIG. 3 breaks, resulting in a state in which the axle box 4 makes contact with the stopper 12. As in TABLE 1, TABLE 2 below also includes attack angles formed between the wheel and the rail in the case of an ordinary truck.

TABLE 2

| | Attack angle when moving on a straight track | Attack angle when moving on a minimally curved track | Angle formed by the axle and the truck |
|---|---|---|---|
| Ordinary truck | 0 | a/R | 0 |
| Steering axle of steering truck | 0 | 0 | X/A (when passing through a minimum curve) |
| Steering device is broken, and stopper-axle box gap magnitude Y = 0 | a/R | 0 | X/A |

TABLE 2 shows that according to the second invention having a steering device 3 of the type illustrated in FIG. 3, by configuring the magnitude Y of the gap so that it is 0 as much as possible, the attack angle formed between the wheel and the rail can be kept lower than the attack angle when an ordinary truck is passing through a minimum curve, even if the steering device 3 is broken.

According to the first and second inventions having the above-described constitution, safety can be enhanced in the event that the steering device breaks, by making it possible to prevent the truck frame 6 and the wheel axle 2 from separating even if the steering device 3 breaks, and by making it possible to limit an attack angle formed between a wheel and a rail so that it is on the same level as an attack angle when an ordinary truck is passing through a curve.

According to the first and second inventions described above, it is desirable to employ a top spring axle box suspension having an axle spring 13 installed above the axle box 4 (see FIG. 4), in order to reduce the supporting rigidity in the front-back direction of the of the axle box 4, so as not to be subject to an operating reactive force from the side of the truck frame 6 while moving the steering link 3*a* in a front-back direction when steering is performed. If this top spring axle box suspension is employed, it becomes possible to reduce the weight of the steering device 3, because an external force is no longer received from the front-back support of the axle box 4.

Figure 4A:
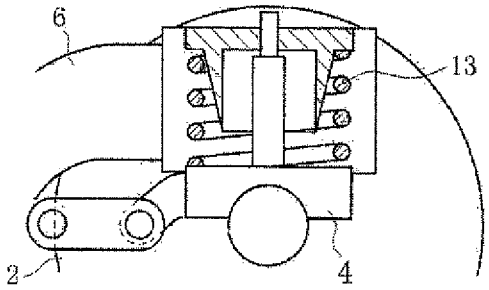
FIG. 4 is a drawing illustrating a top spring axle box suspension.
Figure 4B:
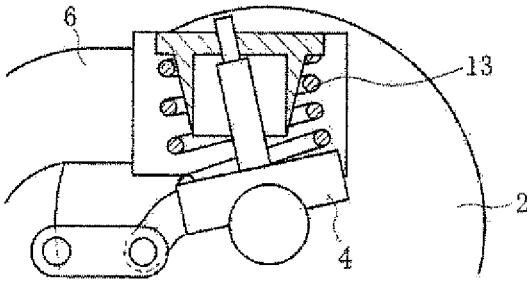

Incidentally, if a top spring axle box suspension is employed, the axle box 4 inclines when steering is performed [see FIG. 4 (*b*)]. Therefore, if a top spring axle box suspension is employed, it is possible to more reliably maintain the interval between the stoppers 12, even if an axle spring bends while bearing a load, as long as an inclination is provided in advance, so that the surface is perpendicular to the surface on the axle box 4 side of the stopper 12 at a time of maximum steering.

The present invention is not limited to the above-described example, and the preferred embodiment may, of course, be advantageously modified within the scope of the technical ideas recited in the claims.

Figure 5:
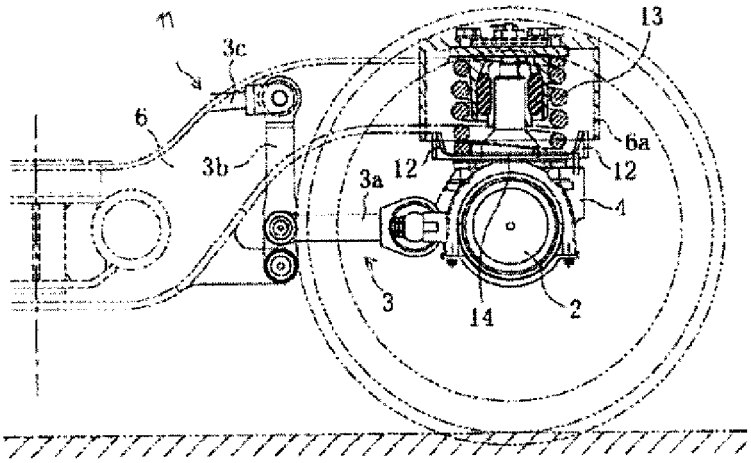
FIG. 5 is a drawing illustrating a specific example of a stopper installed in a steering truck of the present invention.

An illustration of the specific manner in which the stoppers 12 are installed is omitted from FIGS. 1-3, but, for example, as shown in FIG. 5, the stoppers may be arranged in front of and behind an axle spring seat 14 in the vehicle moving direction, so that in the event of damage to the steering device 3, the stoppers 12 will make contact with a spring cover member 6*a* which is formed in the truck frame 6.

The above description made mention of the desirability of using a top spring axle box suspension, in order to restrict the load operating on the steering device 3, but the present invention is not limited to the use of a top spring axle spring suspension. It is also possible to use a steering truck equipped with a wing-type axle spring suspension.

The steering system used in the steering truck of the present invention can be either an active forced steering system or a semi-forced steering system. An active forced steering system employs an air pressure-type, hydraulic-type, or electric-type actuator to supply energy from outside of the system to actively steer a wheel axle while controlling it. A semi-forced steering system employs a mechanical mechanism such as a link to couple the vehicle body, the truck, and the wheel axles, and employs bogie displacement which occurs between the vehicle body and the truck as a driving force while passing through a curve.

EXPLANATION OF THE REFERENCE NUMERALS

2 Steering axle
3 Steering device
3*a* Steering link
3*b* Steering lever
3*c* Connecting link
4 Axle box
6 Truck frame
7 Bolster
11 Steering truck
12 Stopper

The invention claimed is:

1. A railway vehicle steering truck comprising:
axle boxes that rotatably support a steering axle;
a steering lever rotatably connected to a truck frame portion;
a steering link rotatably connected to an axle body portion;
connecting links rotatably connected to a vehicle body portion;
a steering device comprising the steering lever, the steering link, and one of the connecting links, the steering link and the one connecting link being rotatably connected to the steering lever, wherein the respective axle box is supported in a front-back direction along a vehicle moving direction by the steering device;
stoppers installed on both a side where a wheelbase of the truck frame portion extends in a front-back direction and on a side where the wheelbase of the truck frame portion contracts in the front-back direction;
a spring cover member provided in the truck frame portion; and
wherein the stoppers and the spring cover member are arranged and configured such that the stoppers make contact with the spring cover member in an event of damage to the steering device.

2. The steering truck according to claim 1, wherein there is no installation of an axle box front-back suspension which performs front-back support in a direction of travel of the axle box with respect to the truck and in parallel to the steering device.

3. The steering truck according to claim 2, further comprising a top spring axle box suspension having an axle spring installed above the axle box with the spring cover member.

4. The steering truck according to claim 1, further comprising a top spring axle box suspension having an axle spring installed above the axle box with the spring cover member.

5. A railway vehicle steering truck comprising:
axle boxes that rotatably support a steering axle;
a steering lever rotatably connected to a truck frame portion;
a steering link rotatably connected to an axle body portion;
connecting links rotatably connected to a vehicle body portion;
a steering device comprising the steering lever, the steering link, and one of the connecting links, the steering link and the one connecting link being rotatably connected to the steering lever, wherein axle boxes among the axle boxes arranged in a front-back direction of a vehicle moving direction on the same side along a vehicle width direction is supported in a front-back direction along a vehicle moving direction by the steering link and the steering device; and
stoppers installed on both a side where a wheelbase of the truck frame portion extends in a front-back direction and on a side where the wheelbase of the truck frame portion contracts in the front-back direction;
a spring cover member provided in the truck frame portion; and
wherein the stoppers and the spring cover member are arranged and configured such that the stoppers make contact with the spring cover member in an event of damage to the steering device.

6. The steering truck according to claim 5, wherein there is no installation of an axle box front-back suspension which performs front-back support in a direction of travel of the axle box with respect to the truck and in parallel to the steering device.

7. The steering truck according to claim 6, further comprising a top spring axle box suspension having an axle spring installed above the axle box with the spring cover member.

8. The steering truck according to claim 5, further comprising a top spring axle box suspension having an axle spring installed above the axle box with the spring cover member.

* * * * *